US008403171B2

(12) United States Patent
Chou et al.

(10) Patent No.: US 8,403,171 B2
(45) Date of Patent: Mar. 26, 2013

(54) ENCLOSURE WITH FLANGE

(75) Inventors: Tsun-Hsien Chou, Taipei Hsien (TW); Chung-Cheng Hsieh, Taipei Hsien (TW); Li-Ping Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 390 days.

(21) Appl. No.: 12/728,390

(22) Filed: Mar. 22, 2010

(65) Prior Publication Data

US 2011/0121005 A1 May 26, 2011

(30) Foreign Application Priority Data

Nov. 25, 2009 (CN) ..... 2009 2 0315675 U

(51) Int. Cl.
*B65D 6/40* (2006.01)

(52) U.S. Cl. ..... 220/661; 220/601; 220/657; 220/676; 206/701

(58) Field of Classification Search ..... 220/601, 220/657, 661, 676; 206/701
See application file for complete search history.

(56) References Cited

U.S. PATENT DOCUMENTS 5,918,757 A * 7/1999 Przytulla et al. ..... 220/288
6,419,109 B1 * 7/2002 Julien et al. ..... 220/608

* cited by examiner

*Primary Examiner* — Anthony Stashick
*Assistant Examiner* — Elizabeth Volz
(74) *Attorney, Agent, or Firm* — Altis Law Group, Inc.

(57) ABSTRACT

An enclosure includes a bottom panel and a side panel extending from the bottom panel. The side panel is substantially perpendicular to the bottom panel. The side panel has an opening and a flange surrounding the opening. A cross section of the flange includes a first side portion, a bent portion extending from the first side portion, and a second side portion. An angle is defined by the second side portion and the side panel is larger than 90 degrees. The flange is configured to prevent the opening to be deformed.

4 Claims, 4 Drawing Sheets

ENCLOSURE WITH FLANGE

BACKGROUND

1. Technical Field

The disclosure generally relates to enclosures, especially to an enclosure with a reinforcement flange around an opening.

2. Description of Related Art

An enclosure may have many openings. Some of the openings guide air flows into the enclosure, and some of the openings allow connecting lines to pass to and from the interior of the enclosure. However, openings can weaken panels of the enclosure, thereby affecting the structural integrity of the enclosure. Furthermore, edges of the openings may be deformed easily, if force is applied to the enclosure.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
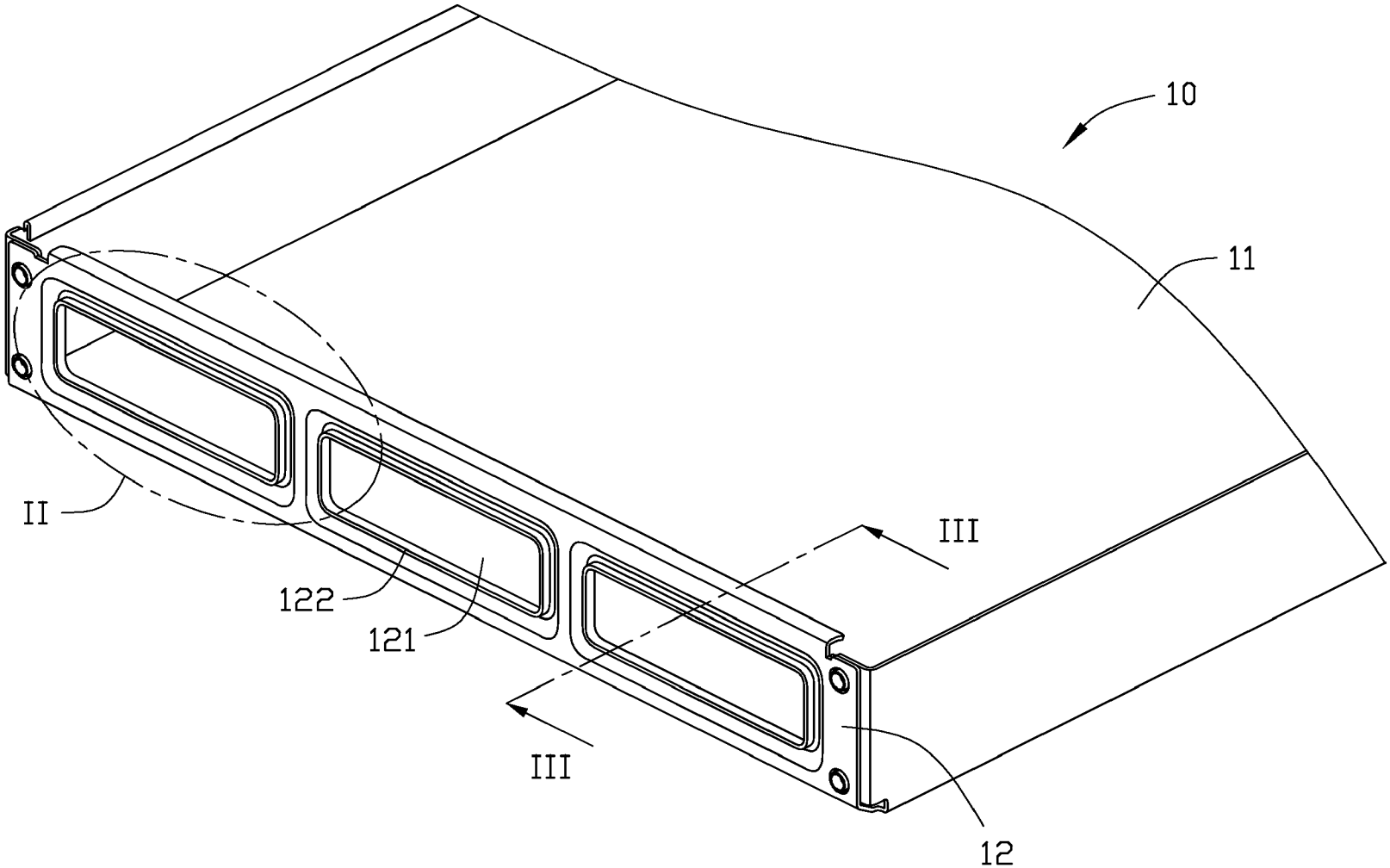
FIG. 1 is an isometric view of an embodiment of an enclosure.
Figure 2:
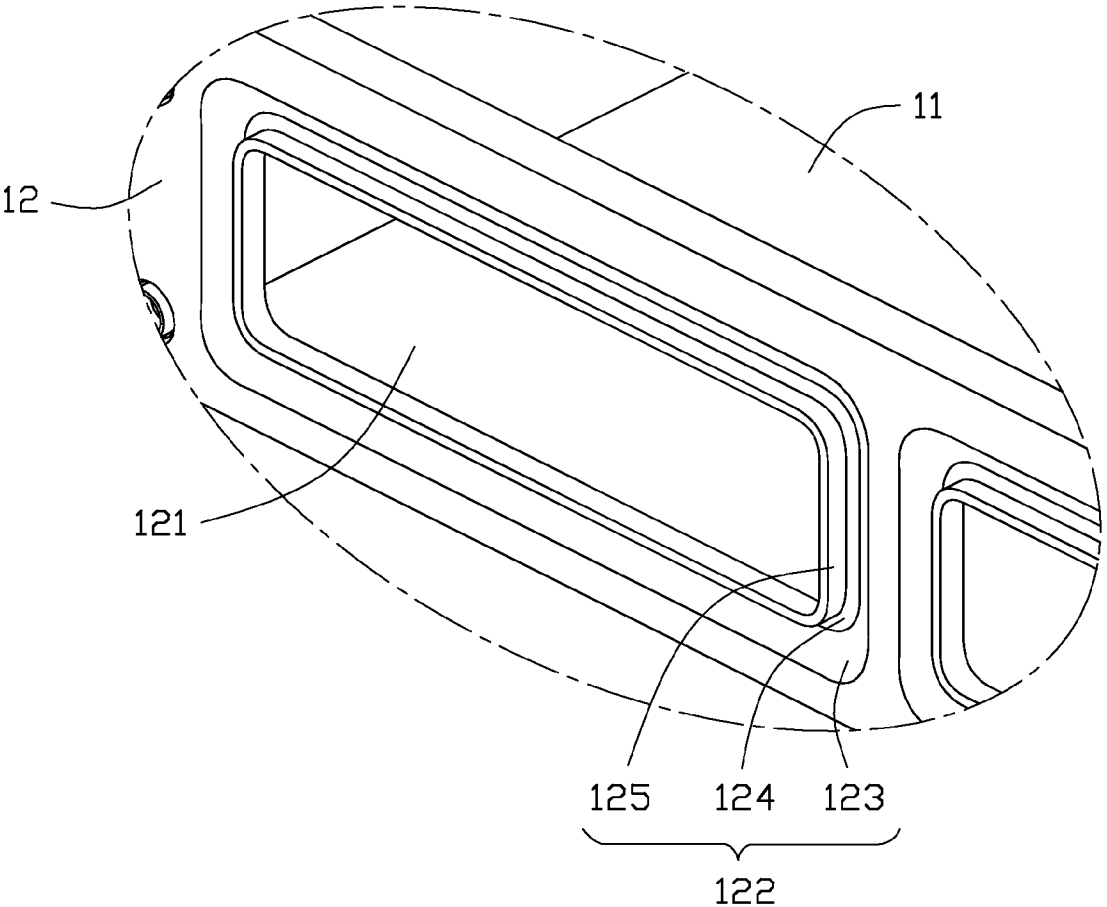
FIG. 2 is a partial enlarged, isometric view of FIG. 1, showing section II.

Referring to FIGS. 1 and 2, an enclosure 10 includes a bottom panel 11 and a side panel 12 extending substantially perpendicularly from the bottom panel 11.

The side panel 12 defines a plurality of openings 121. In one embodiment, the openings 121 may be cutouts. The side panel defines a flange 122 surrounding the opening 121. In another embodiment, the flange 122 only partially surrounds the opening 121.

Figure 3:
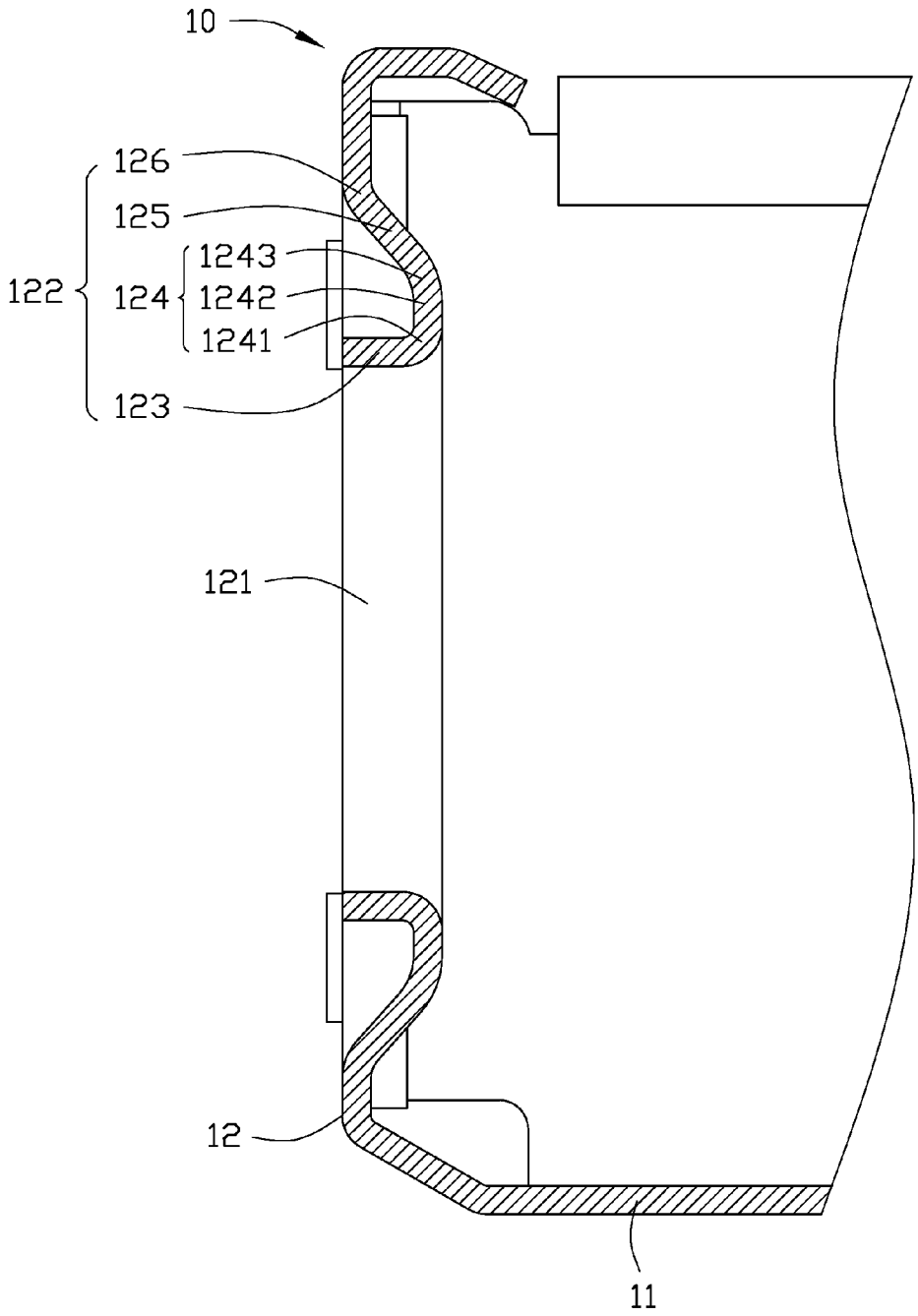
FIG. 3 is a cross section view of one embodiment of FIG. 1, taken along line III-III.

Referring to FIG. 3, the cross section of the flange 122 includes a first side portion 123, a bent portion 124 extending from the first side portion 123, and a second side portion 125 extending from the bent portion 124. The first side portion 123 is substantially perpendicular to the side panel 12. The first side portion 123 is formed as an edge of the opening 121. A first angle defined by the second side portion 125 and the side panel 12 is larger than about 90 degrees. The bent portion 124 includes a first arced portion 1241, a connecting portion 1242 extending from the first arced portion 1241, and a second arced portion 1243. The first arced portion 1241 is tangent to the first side portion 123. The second arced portion 1243 is tangent to the connecting portion 1242 and the second side portion 125. The first side portion 123 is substantially perpendicular to the connecting portion 1242. A second angle defined by the second side portion 125 and the connecting portion 1242 is larger than about 90 degrees. The second side portion 125 is connected to the side panel 12 via a third arced portion 126.

Figure 4:
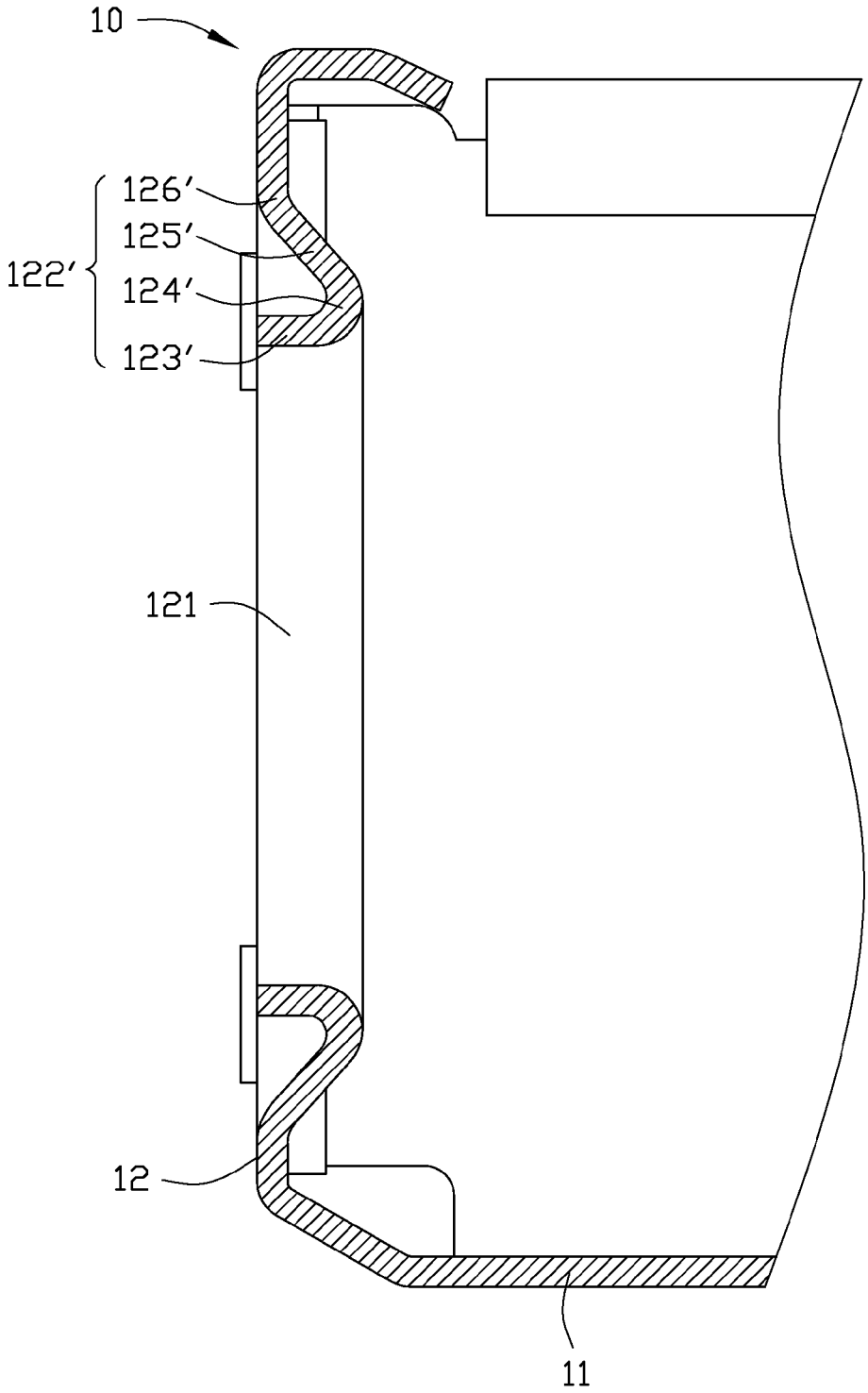
FIG. 4 is a cross section view of another embodiment of FIG. 1, taken along line III-III.

Referring to FIG. 4, the cross section of a flange 122' of another embodiment includes a first side portion 123', a bent portion 124' extending from the first side portion 123', and a second side portion 125' extending from the bent portion 124'.

The first side portion 123' is adjacent to the opening 121. An angle defined by the second side portion 125' and the side panel 12 is larger than about 90 degrees. The bent portion 124' can have an arc-shape. The bent portion 124' is tangent to the first side portion 123' and the second side portion 125'. The second side portion 125' is connected to the side panel 12 via an arced portion 126'. The first side portion 123' is substantially perpendicular to the side panel 12.

The flange 122 or 122' of the side panel 12 elastically deforms when force is applied on the side panel 12 in a direction substantially parallel to the side panel 12, thereby reinforcing the structural integrity of the side panel 12.

It is to be understood, however, that even though numerous characteristics and advantages have been set forth in the foregoing description of embodiments, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An enclosure, comprising:

a bottom panel; and a side panel extending from the bottom panel, the side panel being substantially perpendicular to the bottom panel, the side panel having a plurality of openings substantially arranged in a line, each opening is rectangular, a flange surrounding each opening, a cross section of the flange comprising a first side portion, a bent portion extending from the first side portion, and a second side portion, wherein an angle defined by the second side portion and the side panel is larger than about 90 degrees; the flange enhances the structural integrity of the side panel if force is applied on the side panel in a direction parallel to the side panel;

wherein the bent portion comprises a first arced portion, a connecting portion extending from the first arced portion, and a second arced portion extending from the connecting portion; the first arced portion is connected to the first side portion, and the second arced portion is connected to the second side portion;

the first arced portion is tangent to the connecting portion, and the second arced portion is tangent to the connecting portion and the second side portion.

2. The enclosure of claim 1, wherein the first side portion is substantially perpendicular to the connecting portion.

3. An enclosure, comprising:

a bottom panel; and a side panel extending from the bottom panel, the side panel being substantially perpendicular to the bottom panel, the side panel having a plurality of openings substantially arranged in a line, each opening is rectangular, the side panel being concaved to form a flange surrounding each opening, a cross section of the flange comprising a first side portion, a bent portion extending from the first side portion, and a second side portion extending from the bent portion; the first side portion being adjacent to the opening and the second side portion being further away from the opening, wherein an angle defined by the second side portion and the side panel is larger than about 90 degrees; the flange enhances the structural integrity of the side panel if force is applied on the side panel in a direction parallel to the side panel;

wherein the bent portion comprises a first arced portion, a connecting portion extending from the first arced portion, and a second arced portion extending from the connecting portion;

the first arced portion connected to the first side portion, and the second arced portion connected to the second side portion;

the first arced portion is tangent to the connecting portion, and the second arced portion is tangent to the connecting portion and the second side portion.

4. The enclosure of claim 3, wherein the first side portion is substantially perpendicular to the connecting portion.

* * * * *